US012007209B2

(12) United States Patent
Steve

(10) Patent No.: US 12,007,209 B2
(45) Date of Patent: Jun. 11, 2024

(54) TARGET TRAINING SYSTEM WITH SIMULATED MUZZLE FLASH ELEMENTS

(71) Applicant: Reactionary Gap, LLC, Sparks, NV (US)

(72) Inventor: Keefer Steve, Sparks, NV (US)

(73) Assignee: Reactionary Gap, LLC, Sparks, NV (US)

( * ) Notice: Subject to any disclaimer, the term of this patent is extended or adjusted under 35 U.S.C. 154(b) by 700 days.

(21) Appl. No.: 17/037,132

(22) Filed: Sep. 29, 2020

(65) Prior Publication Data

US 2021/0215463 A1 Jul. 15, 2021

Related U.S. Application Data

(60) Provisional application No. 62/913,398, filed on Oct. 10, 2019.

(51) Int. Cl.
*F41J 2/00* (2006.01)

(52) U.S. Cl.
CPC ..... *F41J 2/00* (2013.01)

(58) Field of Classification Search
CPC ..... F41J 2/00; F41J 5/24
USPC ..... 434/16
See application file for complete search history.

(56) References Cited

U.S. PATENT DOCUMENTS 5,437,463 A * 8/1995 Fromm ..... F41G 3/2655 434/21
2013/0260342 A1* 10/2013 Stanley ..... F41G 3/2655 434/16
2014/0227666 A1* 8/2014 Milanov ..... F41A 33/02 434/16
2016/0252325 A1* 9/2016 Sammut ..... G01S 19/13 42/122
2019/0070512 A1* 3/2019 Fuller ..... A63F 13/75
2019/0154401 A1* 5/2019 Almagor ..... F41G 3/142

* cited by examiner

*Primary Examiner* — Robert P Bullington
*Assistant Examiner* — Stephen Alvesteffer
(74) *Attorney, Agent, or Firm* — Mark A. Goodman, Esq.

(57) ABSTRACT

Target shooting systems and methods are disclosed herein for exposing shooters to simulated muzzle flashes and monitoring training using a computing device, software application, audio, video, an electrocardiogram ("EKG"), and wireless communications. The target shooting replicates the visual and audio experience of a muzzle flash thereby simulating live return fire as closely as possible while maintaining safety. The trainee has the ability to shoot live ammunition at a target that is simulating shooting back at the trainee. The EKG is able to measure heart rates over time and transfer the data to the software application on the computing device. The video camera can transfer recorded video data to the software application. Sensors on the target can transfer impact data to the software application so that hit/miss ratios can be calculated. Target systems can include metal targets or cardboard targets.

12 Claims, 12 Drawing Sheets

TARGET TRAINING SYSTEM WITH SIMULATED MUZZLE FLASH ELEMENTS

CROSS-REFERENCE TO RELATED APPLICATIONS

This is a Nonprovisional Utility U.S. patent application under 37 CFR 1.53(b). This application claims priority to U.S. Provisional Patent Application No. 62/913,398

BACKGROUND OF THE INVENTION

1. Field of the Invention

The present invention relates generally to target shooting training systems and methods. More particularly, the present invention relates to a target shooting system exposing shooters to simulated muzzle flashes and monitoring training using a software application, audio, video, an electrocardiogram, and wireless communications.

2. Description of Related Art

Target shooting training and real shooting scenarios produce different levels of stress on shooters. Target shooting is a much less stressful environment for a shooter than shooting scenarios involving another person firing back at the shooter. In a deadly force real life situation, real muzzle flash is almost always overwhelming for inexperienced people. It is necessary to provide training with high levels of stress so that shooters can improve their performance in these conditions. For example, law enforcement training requires putting stress on officers to see how they perform while their heartrates are high. Military personnel also require similar training. A goal for a trainee shooter is to overcome the stress of being fired at, while moving laterally, drawing a firearm, and placing accurate shots on a target.

There is a need in the field for a system and method to expose shooters to realistic simulated muzzle flashes and effectively monitor their training to provide rapid feedback. There is a need to place trainee shooters in artificial realistic scenarios so that trainees can better manage stress if an encounter requiring deadly force later ensues.

SUMMARY OF THE INVENTION

Target shooting systems and methods are disclosed herein for exposing shooters to simulated muzzle flashes and monitoring training using a computing device, software application, audio, video, an electrocardiogram ("EKG"), and wireless communications. The software application can be installed on a computing device, including a cell phone, tablet, laptop, desktop, and the like. The target shooting training system has a light source creating a replicated muzzle flash, a headset producing a replicated gunshot sound, a video camera recording the training session, sensors recording successful shots on target, and an EKG to measure heartrates. The trainee has the ability to shoot live ammunition at a target that is simulating shooting back at the trainee. The EKG is able to measure heart rates over time and transfer the data to the software application on the computing device. The video camera can transfer recorded video data to the software application. Sensors on the target can transfer impact data to the software application so that hit/miss ratios can be calculated.

Target systems can include metal targets or cardboard targets. A metal target system has a target constructed of metal with metal sleeves fastened to the rear of the target. One metal sleeve includes a muzzle flash simulator and a light that protrudes through a hole in the front of the metal target. Another metal sleeve includes a video camera with a lens that protrudes through another hole in the front of the metal target. A cardboard target system has a target constructed of cardboard with plastic sleeves affixed to a foam backing adhered to the rear of the target. Plastic stops are used to secure the plastic sleeves to the foam backing. One plastic sleeve includes a muzzle flash simulator and a light that protrudes through a hole in the front of the cardboard target. Another plastic sleeve includes a video camera with a lens that protrudes through another hole in the front of the cardboard target.

These and other features and advantages will be apparent from reading of the following detailed description and review of the associated drawings. It is to be understood that both the forgoing general description and the following detailed description are explanatory and do not restrict aspects as claimed.

DETAILED DESCRIPTION OF EMBODIMENTS

The following descriptions relate principally to preferred embodiments while a few alternative embodiments may also be referenced on occasion, although it should be understood that many other alternative embodiments would also fall within the scope of the invention. The embodiments disclosed are not to be construed as describing limits to the invention, whereas the broader scope of the invention should instead be considered with reference to the claims, which may be now appended or may later be added or amended in this or related applications. Unless indicated otherwise, it is to be understood that terms used in these descriptions generally have the same meanings as those that would be understood by persons of ordinary skill in the art. It should also be understood that terms used are generally intended to have the ordinary meanings that would be understood within the context of the related art, and they generally should not be restricted to formal or ideal definitions, conceptually encompassing equivalents, unless and only to the extent that a particular context clearly requires otherwise.

For purposes of these descriptions, a few wording simplifications should also be understood as universal, except to the extent otherwise clarified in a particular context either in the specification or in particular claims. The use of the term "or" should be understood as referring to alternatives, although it is generally used to mean "and/or" unless explicitly indicated to refer to alternatives only, or unless the alternatives are inherently mutually exclusive. Furthermore, unless explicitly dictated by the language, the term "and" may be interpreted as "or" in some instances. When referencing values, the term "about" may be used to indicate an approximate value, generally one that could be read as being that value plus or minus half of the value. "A" or "an" and the like may mean one or more, unless clearly indicated otherwise. Such "one or more" meanings are most especially intended when references are made in conjunction with open-ended words such as "having," "comprising" or "including." Likewise, "another" object may mean at least a second object or more. Thus, in the context of this specification, the term "comprising" is used in an inclusive sense and thus should be understood as meaning "including, but not limited to." As used herein, the use of "may" or "may be" indicates that a modified term is appropriate, capable, or suitable for an indicated capacity, function, or usage, while considering that in some circumstances the modified term may sometimes not be appropriate, capable, or suitable. A "computing device" can be a desktop, laptop, tablet, cell phone, and the like.

Figure 1:
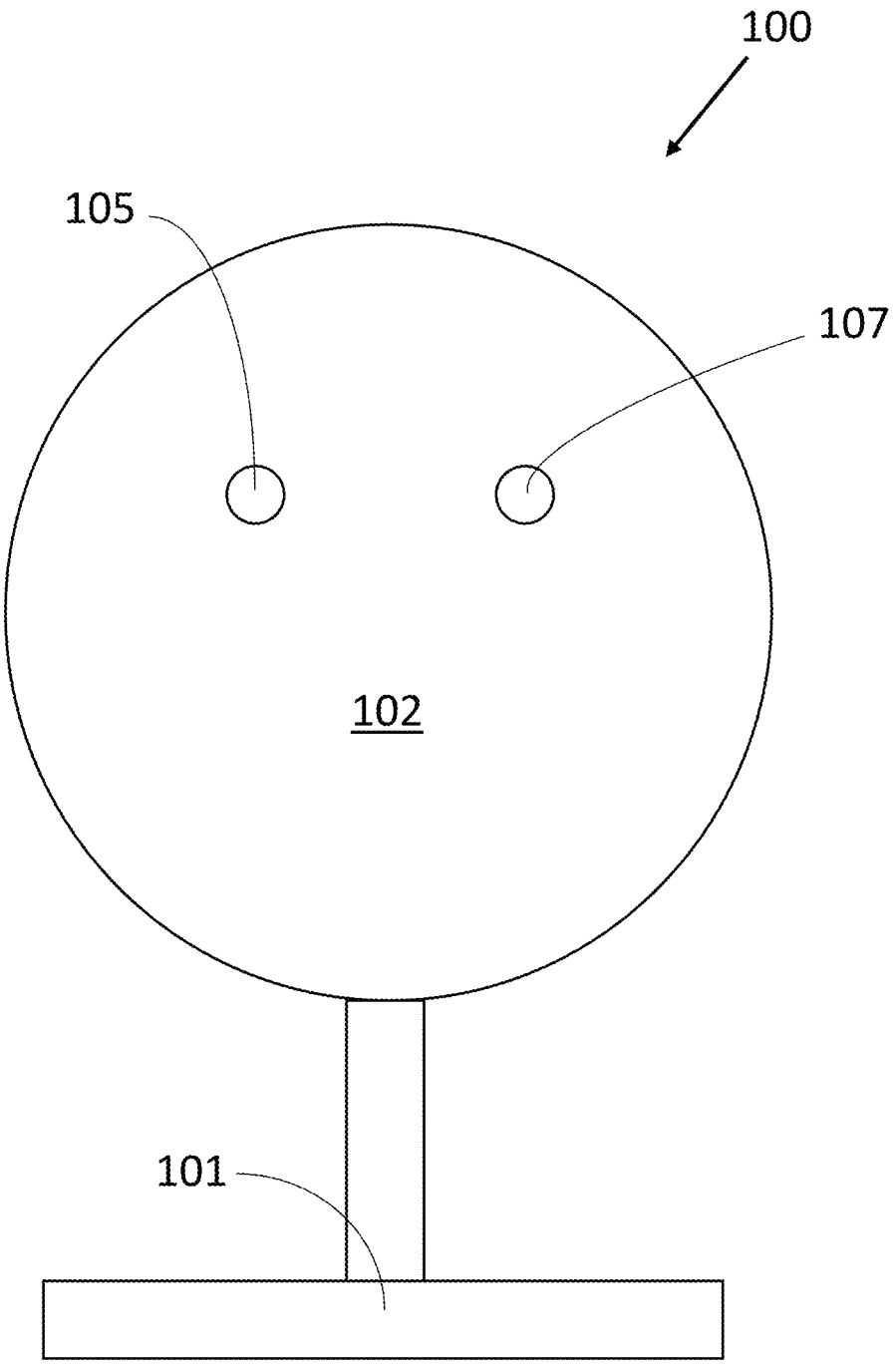
FIG. 1 illustrates a front view of a metal target implemented as part of a target system.
Figure 12:
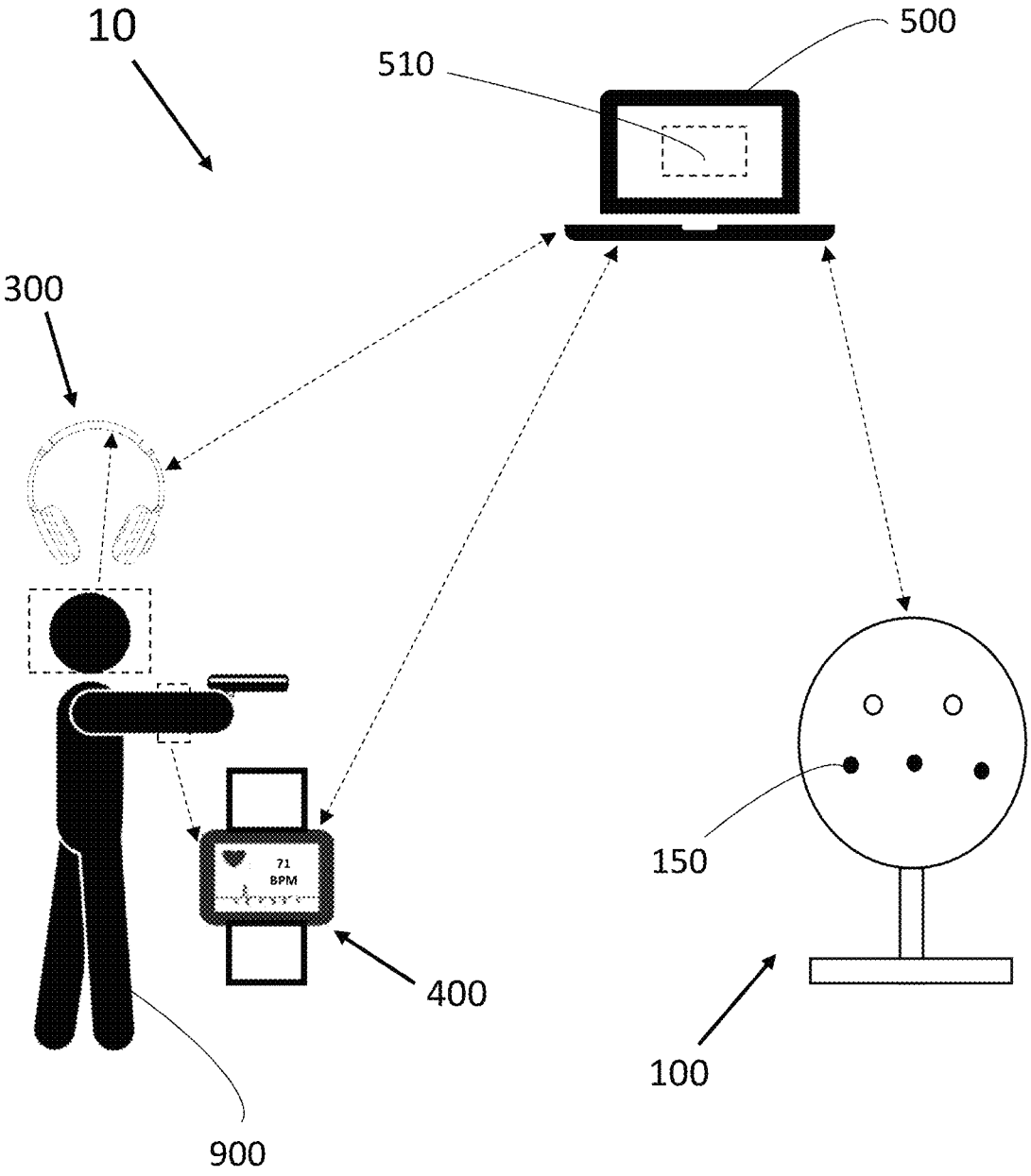
FIG. 12 illustrates a target system with a metal target, a shooter/user, a device for firing a projectile, a wireless headset, and an EKG, and a computing device.

FIG. 1 illustrates a front view of a metal target 100 implemented as part of a target system 10 (shown in FIG. 12). A stand 101 rests on a ground surface and functions as a target support. The stand 101 is preferably constructed of a durable material such as metal or wood. A target impact area 102 is affixed to the stand 101 and is preferably constructed of a metal, such as steel. The target impact area 102 has at least one hole 105 enabling light to flow from a muzzle flash simulator. The target impact area 102 also has at least one hole 107 enabling a camera to capture images. In this example, the holes 105, 107 each have a diameter of ⅛ inch and a depth of ½ inch. The metal target 100 can be any size or shape. In this example, the target impact area 102 is circular shaped with a diameter of twelve inches and a thickness of ¾ inches.

Figure 2A:
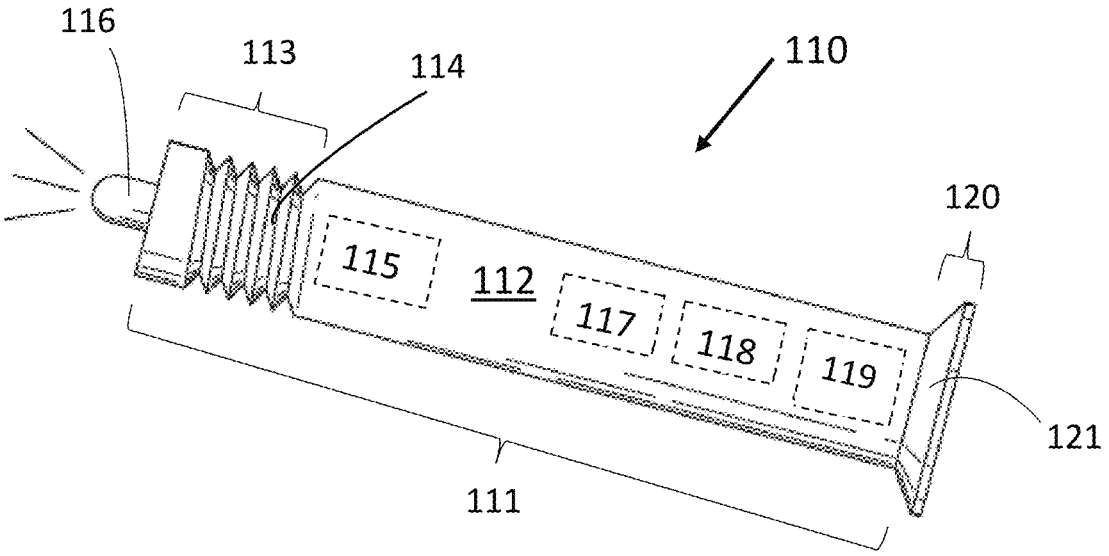
FIG. 2A illustrates a muzzle flash simulator that is employed in target system.

FIG. 2A illustrates a muzzle flash simulator 110 that is employed in target system 10. A metal sleeve 111 houses internal components of the muzzle flash simulator 110. The metal sleeve body 112 is preferably cylindrically shaped and four inches in length with a ½ inch diameter, although the body 112 can have various lengths and diameters. A first end 113 of the metal sleeve 111 includes a plurality of male threads 114. The male threads 114 are preferably sized in accordance with national pipe thread (NPT) standards for a nominal pipe size of ⅜ inches and a thread density of eighteen threads per inch (TPI). Other nominal pipe sizes can also be implemented in the metal sleeve 111. A light source 115 is installed in muzzle flash simulator 110 and located near the first end 113 within metal sleeve 111. The light source 115 is preferably a light emitting diode although other light sources can be implemented. A light bulb 116 is operatively connected to the light source 115 and protrudes from the first end 113. When the light source 115 is activated and turned on, the light appears as a "simulated muzzle flash," as if the target 100 was firing bullets at the shooter. A second end 120 of the metal sleeve 111 includes an end cap 121. The end cap 121 encloses the second end 120 of the metal sleeve 111 and can have various diameters and lengths so long as the diameter is large enough to enclose the second end 120.

The muzzle flash simulator 110 further includes a communication device 117 and a processor 118 installed within metal sleeve 111. The communication device 117 preferably uses Bluetooth to communicate, although other wireless communication systems such as WiFi can be implemented. The communication device 117 is configured to wirelessly receive instructions transmitted from a computing device 500 (shown in FIGS. 12 and 13). A software application 510 is installed in the computing device so that a user can give instructions to the software and the computing device can wirelessly transmit the instruction data to the communication device 117. The communication device 117 can transmit the received instruction data to the processor 118 so that the processor can control the light source 115. A power supply (e.g. battery) 119 provides electrical power to the muzzle flash simulator 110 and is installed within metal sleeve 111.

Figure 2B:
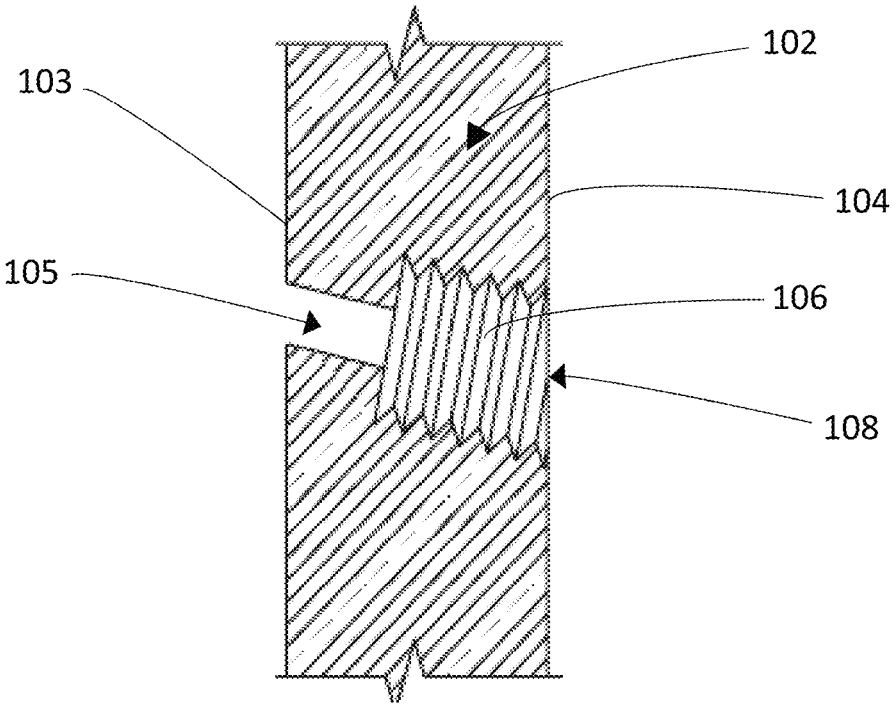
FIG. 2B illustrates a cross-sectional side view of the target impact area of the metal target system.

FIG. 2B illustrates a cross-sectional side view of the target impact area 102 of the metal target system 10. In this example, the target impact area 102 has a thickness of ¾ inches and has holes of different diameters in the front 103 and rear 104. A first hole 108 is located in the rear side 104 and includes a plurality of female threads 106. The first hole 108 is preferably angled so that the entry point at the rear side 104 is below the other portions of the hole 108 and below a front hole 105, relative to the ground. In this example, the angle is fifteen degrees relative to the ground and the depth of the hole 108 is ¼ inch. The female threads 106 are preferably sized in accordance with national pipe thread (NPT) standards for a nominal pipe size of ⅜ inches and a thread density of eighteen threads per inch (TPI). Another hole 105 is located in the front side 103 of the target impact area 102 and in this example has a diameter of ⅛ inch and a depth of ½ inch. With cross reference to FIG. 1, the hole 105 enables light to flow from a muzzle flash simulator. The target impact area 102 also has at least one hole 107 enabling a camera to capture images. The holes in the cross-sectional side view of FIG. 2B can be employed in a similar manner for connecting a muzzle flash simulator 110 or a video camera 130, as is shown in FIGS. 3A and 3B.

Figure 3A:
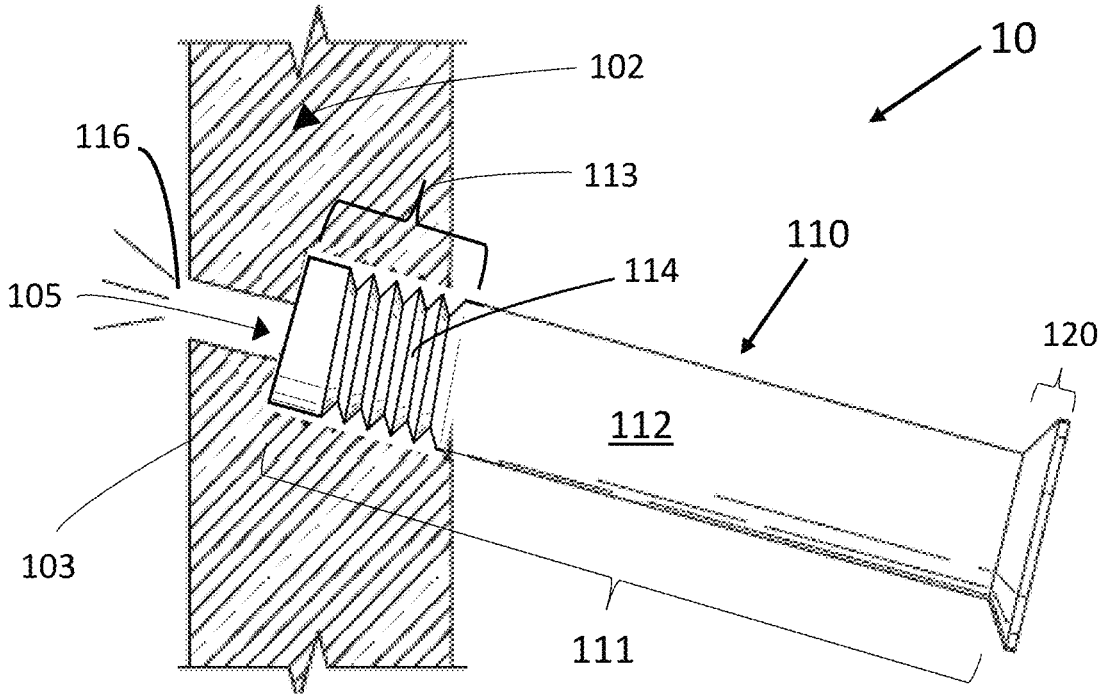
FIG. 3A illustrates a cross-sectional side view of a metal target system with a muzzle flash simulator connected.

FIG. 3A illustrates a cross-sectional side view of a metal target system 10 with a muzzle flash simulator 110 connected. The metal sleeve 111 is operatively connected to the target impact area 102 by fastening the male threads 114 to the female threads 106 (shown in FIG. 2B). A light bulb 116 protrudes from a first end 113 and light flows from the muzzle flash simulator 110 out of a hole 105 in the front side 103 of the target impact area 102. The metal sleeve 111 is angled so that the second end 120 is below the first end 113, relative to the ground. In this example, the angle is fifteen degrees relative to the ground.

Figure 3B:
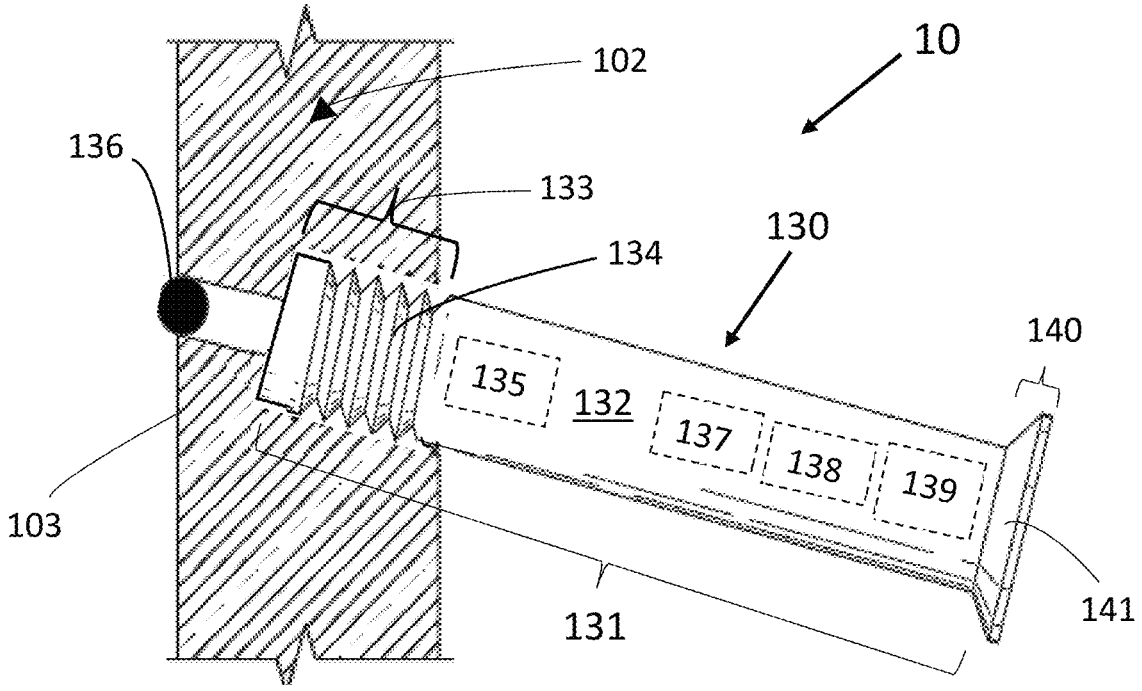
FIG. 3B illustrates a cross-sectional side view of a metal target system with a video camera connected.

FIG. 3B illustrates a cross-sectional side view of a metal target system 10 with a video camera 130 connected. A metal sleeve 131 houses internal components of the video camera 130. The metal sleeve body 132 is preferably cylindrically shaped and four inches in length with a ½ inch diameter, although the body 132 can have various lengths and diameters. A first end 133 of the metal sleeve 131 includes a plurality of male threads 134. The male threads 134 are preferably sized in accordance with national pipe thread (NPT) standards for a nominal pipe size of ⅜ inches and a thread density of eighteen threads per inch (TPI). Other nominal pipe sizes can also be implemented in the metal sleeve 131. Video camera components 135 are installed in the video camera 130 and located near the first end 133 within metal sleeve 131. The video camera 130 is preferably configured to capture images and audio and record the information captured as video data. The camera lens 136 is operatively connected to the video camera components 135 and protrudes from the first end 133. A second end 140 of the metal sleeve 131 includes an end cap 141. The end cap 141 encloses the second end 140 of the metal sleeve 131 and can have various diameters and lengths so long as the diameter is large enough to enclose the second end 140.

In a similar manner to the connection of the muzzle flash simulator 110, the metal sleeve 131 of the video camera 130 is operatively connected to the target impact area 102 by fastening the male threads 134 to the female threads 126 (not shown, similar to female threads 106). The camera lens 136 protruding from the first end 133 enables the video camera 130 to capture video from the front side 103 of the target impact area 102. The metal sleeve 131 is angled so that the second end 140 is below the first end 133, relative to the ground. In this example, the angle is fifteen degrees relative to the ground.

The video camera 130 further includes a communication device 137 and a processor 138 installed within metal sleeve 131. The communication device 137 preferably uses Bluetooth to communicate, although other wireless communication systems such as WiFi can be implemented. The communication device 137 is configured to wirelessly receive instructions transmitted from a computing device. The software application 510 installed in the computing device enables a user can give instructions to the software and the computing device can wirelessly transmit the instruction data to the communication device 137. The communication device 137 can transmit the received instruction data to the processor 138 so that the processor can control the video camera components 135. A power supply (e.g. battery) 139 provides electrical power to the video camera 130 and is installed within metal sleeve 131.

Figure 4A:
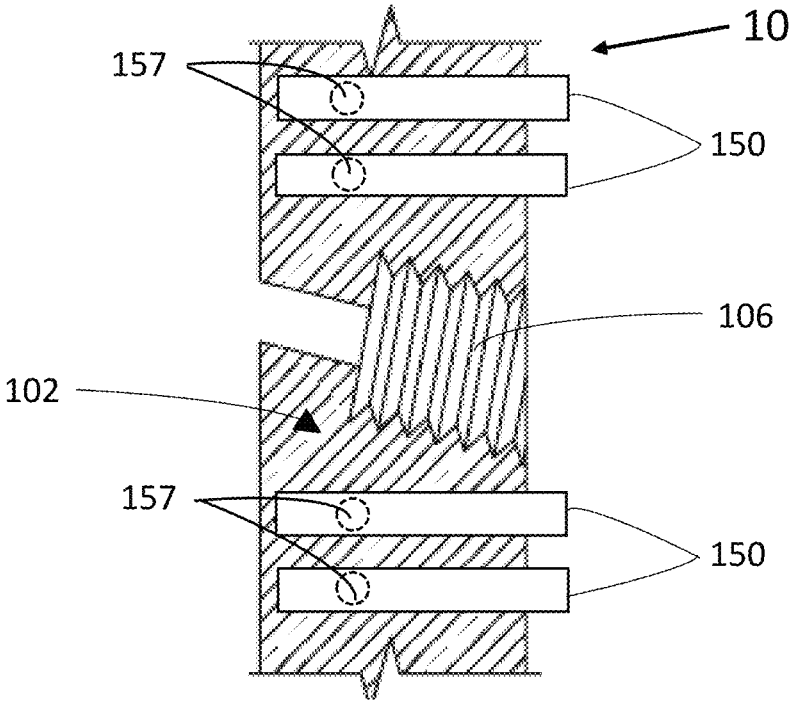
FIG. 4A illustrates a side view of a sensor device operatively connected to the target impact area.

FIG. 4A illustrates a side view of a sensor device 150 operatively connected to the target impact area 102. The metal target system 10 can include one or more sensor devices 150. The sensor device can be mounted or affixed to the target impact area 102. The sensor device 150 preferably includes a vibration sensor (not shown) or impact sensor configured to sense an impact from a projectile. As will be known to those of ordinary skill in the art, the vibration sensor can be a piezoelectric sensor, a capacitive, inductive, electromagnetic, or any sensor capable of detecting vibration/impact. The sensor device 150 further includes a power supply (e.g. battery), a processor, and a communication device. The communication device 157 preferably uses Bluetooth to communicate, although other wireless communication systems such as WiFi can be implemented. The communication device 157 is configured to wirelessly receive instructions transmitted from a computing device. The software application 510 installed in the computing device enables a user can give instructions to the software and the computing device can wirelessly transmit the instruction data to the communication device 157. The communication device 157 can transmit the received instruction data to the processor so that the processor can control the vibration sensor. The vibration sensor is configured to collect and transmit impact data to the communication device. The communication device 157 is further configured to wirelessly transmit the impact data to the computing device. This impact data can include hit/miss ratios and precise target locations hit by the firer of the projectiles. The impact data can be stored in the software application 510 to provide feedback for the projectile firer.

Figure 4B:
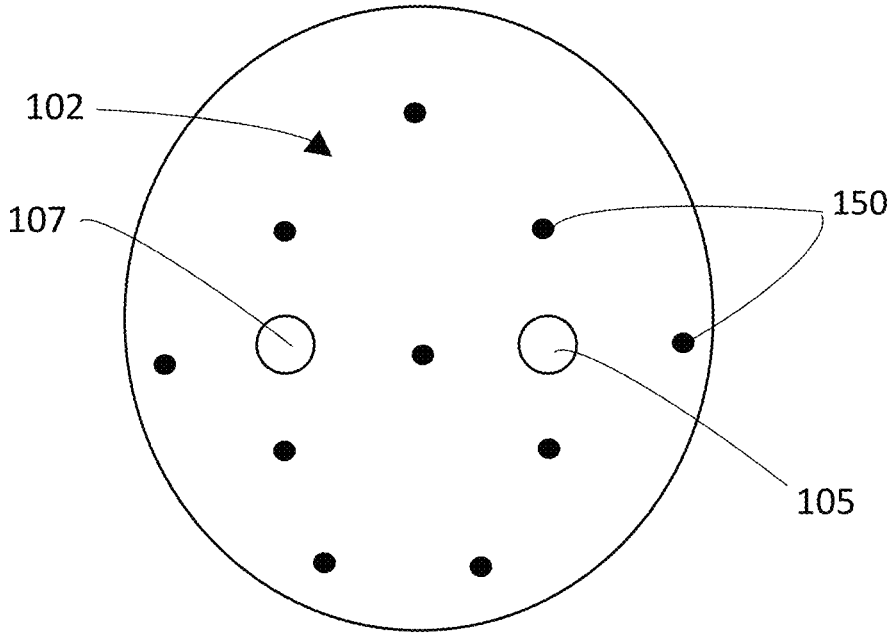
FIG. 4B illustrates a rear view of the target impact area with a plurality of sensor devices.

FIG. 4B illustrates a rear view of the target impact area 102 with a plurality of sensor devices 150. The quantity and location of sensor devices 150 shown in this embodiment is a non-limiting example. Various amounts of sensor devices 150 can be implemented and connected to various locations on the target impact area 102.

Figure 5:
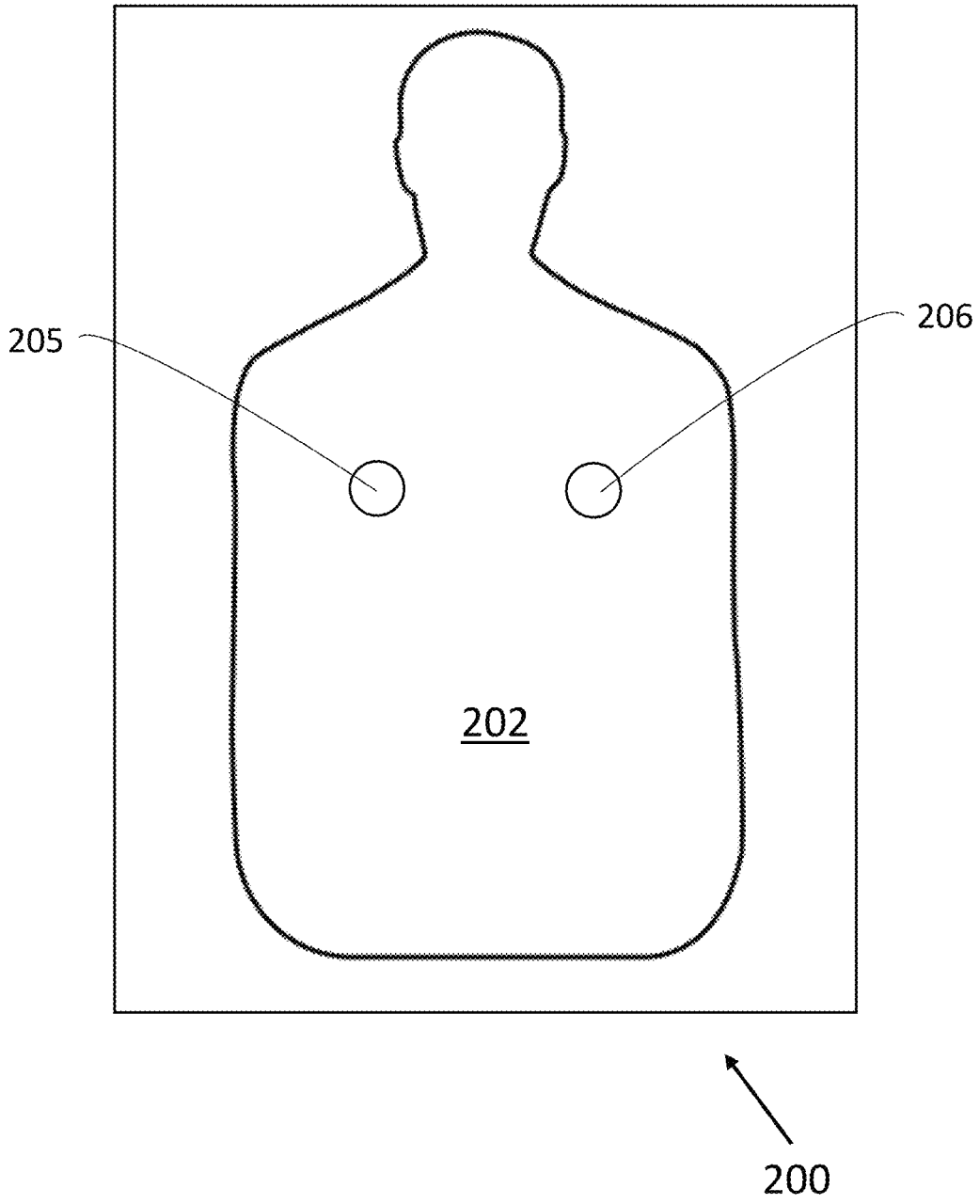
FIG. 5 illustrates a front view of a cardboard target in a target system.
Figure 13:
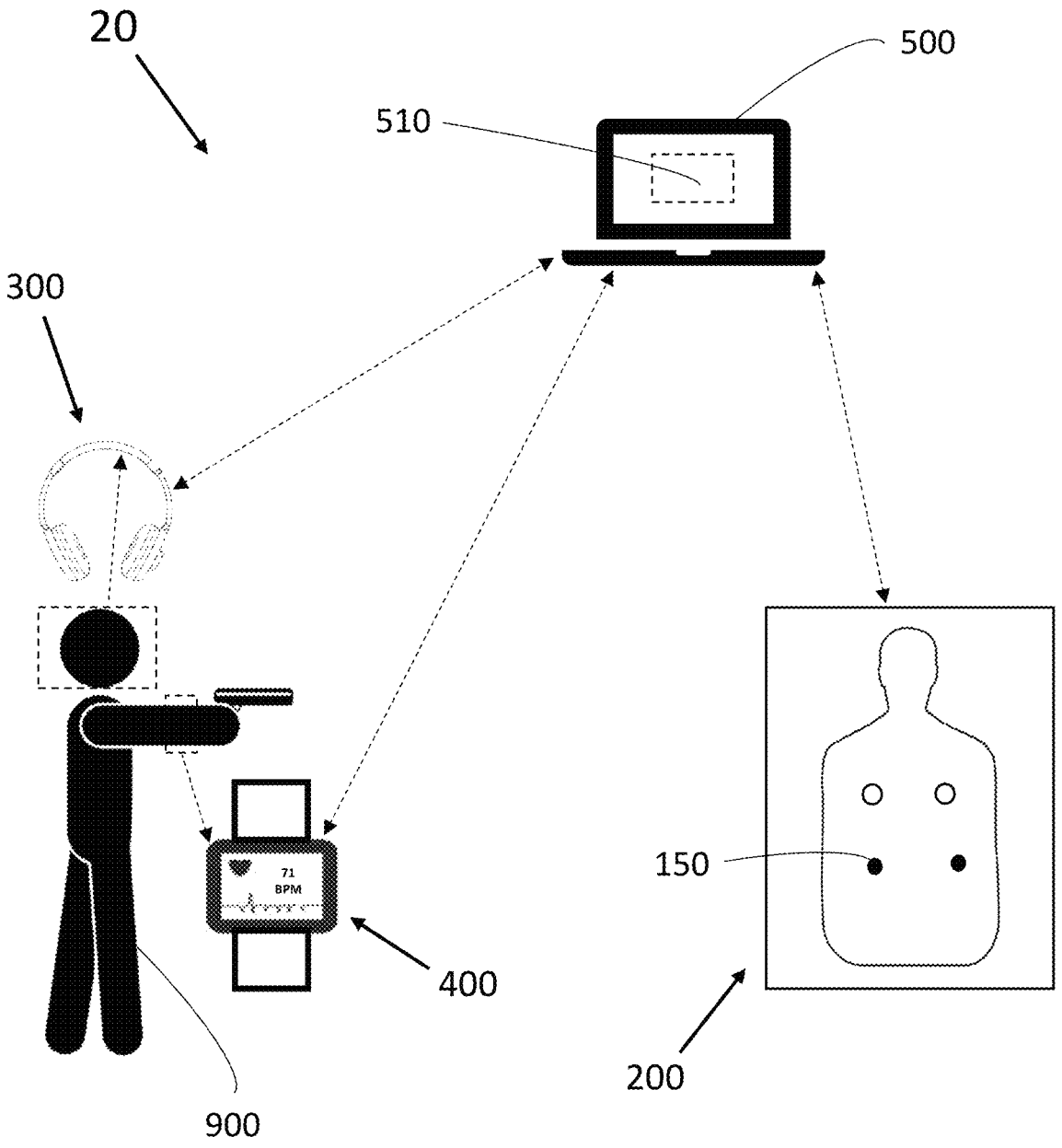
FIG. 13 illustrates a target system with a cardboard target, a shooter/user, a device for firing a projectile, a wireless headset, and an EKG, and a computing device.

FIG. 5 illustrates a front view of a cardboard target 200 in a target system 20 (shown in FIG. 13). The target impact area 202 is preferably constructed of a lightweight material such as cardboard. The target impact area 202 has at least one hole 205 enabling light to flow from a muzzle flash simulator. The target impact area 202 also has at least one hole 206 enabling a camera to capture images. The target system 20 can be any size or shape. In this example, the target impact area 202 is rectangular shaped with a 35 inch length, 23 inch width, and a thickness of ⅛ inches. A human silhouette is shown as an example paper target than can be mounted or affixed to the target impact area 202.

Figure 6A:
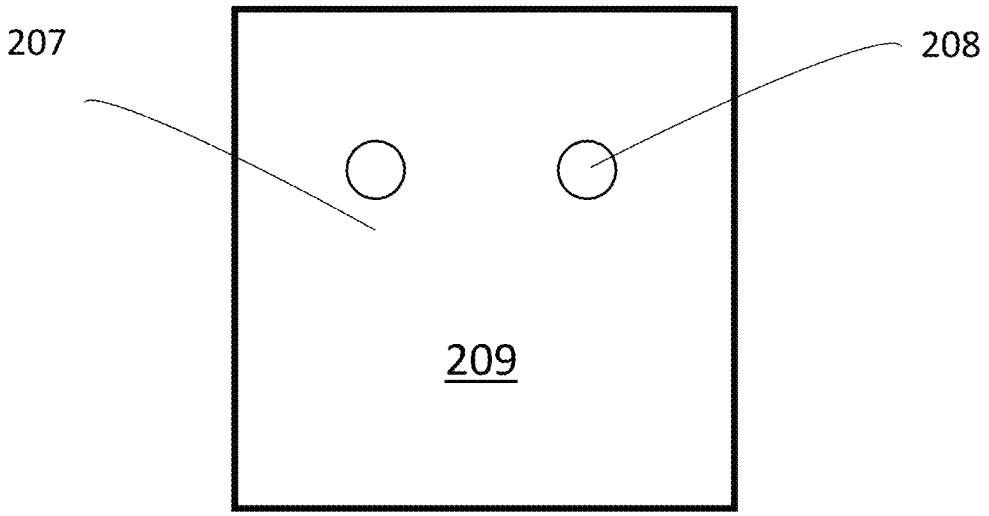
FIG. 6A illustrates a front view of a backing that can be affixed or mounted to the target impact area.

FIG. 6A illustrates a front view of a backing 209 that can be affixed or mounted to the target impact area 202. The backing 209 is preferably a "foam backing" made of a poly foam material such as polyurethane, polystyrene, polyester compounds and the like. The backing 209 has at least one hole 207 for connecting a muzzle flash simulator. Further, the backing 209 has at least one hole 208 for connecting a camera. In this example, the holes 207, 208 each have a diameter of ½ inches. The backing 209 can be any size or shape. In this example, the backing 209 is rectangular shaped with a length and width of four inches.

Figure 6B:
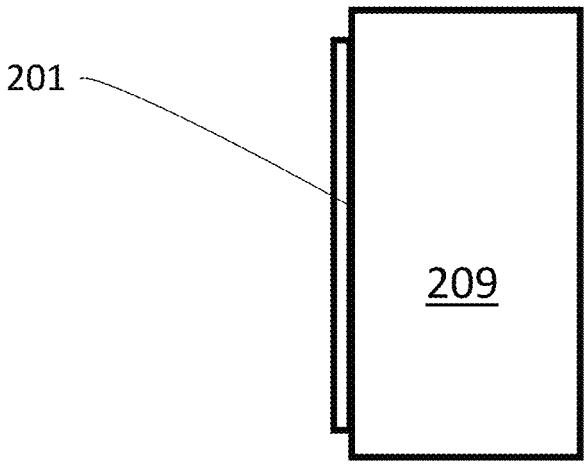
FIG. 6B illustrates a right side view of the foam backing that can be affixed to the target impact area.

FIG. 6B illustrates a right side view of the foam backing 209 that can be affixed to the target impact area 202. Any adhesive 201 such as tape or glue can be used to affix) the backing 209. In this example, double-sided tape 201 is used as the adhesive applied to the front of the backing 209. The backing 209 can have various thicknesses (measured front to rear) and in this example the thickness is 1.5 inches.

Figure 7A:
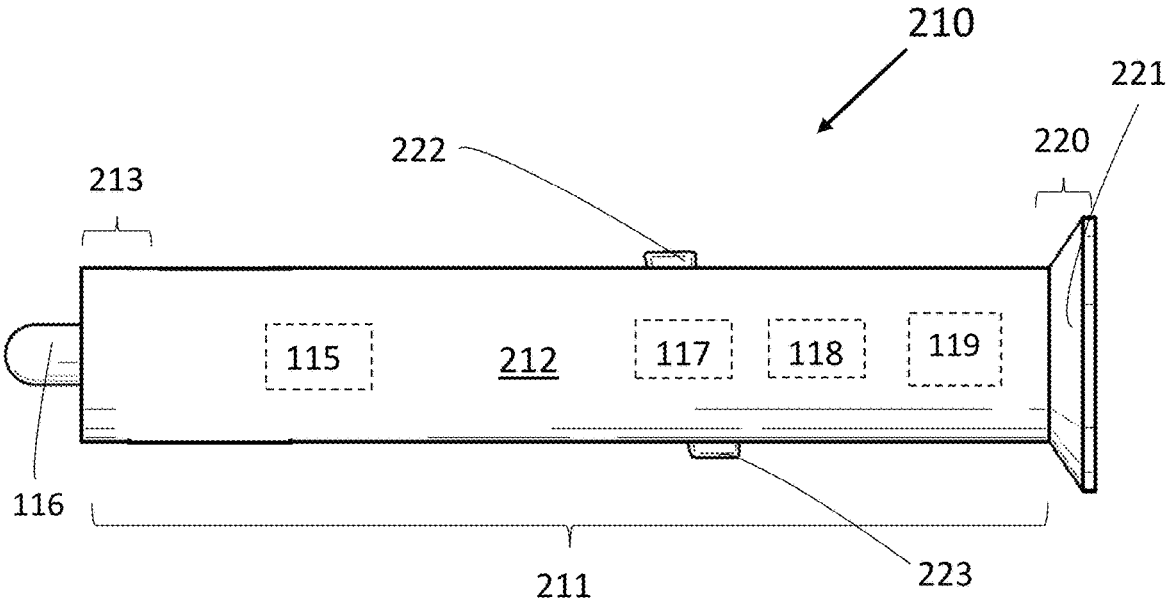
FIG. 7A illustrates a muzzle flash simulator that can be implemented in target system.

FIG. 7A illustrates a muzzle flash simulator 210 that can be implemented in target system 20. Muzzle flash simulator 210 is similar to muzzle flash simulator 110 in target system 10. Notable differences include sizing differences and the muzzle flash simulator 210 having a plastic sleeve 211 and stops 222, 223. The plastic sleeve 211 houses internal components of the muzzle flash simulator 210. The plastic sleeve body 212 is preferably cylindrically shaped and 3.5 inches in length with a diameter of ⅜ inches, although the body 212 can have various lengths and diameters. Stops 222, 223 are mounted on opposite sides of the plastic sleeve 211 and are preferably constructed of plastic or similar material. In the example shown, a first plastic stop 222 is located on the top side of plastic sleeve 211 and a second plastic stop 223 is located on the bottom side. The stops 222, 223 are used to secure the plastic sleeve 211 to the foam backing 209. Including the stops 222, 223 and the diameter of the sleeve body 212, the total diameter of the muzzle flash simulator is ½ inches, in this example. A light source 115 is installed in muzzle flash simulator 210 and located near the first end 213 within plastic sleeve 211. The light source 115 is preferably a light emitting diode although other light sources can be implemented. A light bulb 116 is operatively connected to the light source 115 and protrudes from the first end 213. A second end 220 of the plastic sleeve 211 includes an end cap 221. The end cap 221 encloses the second end 220 of the plastic sleeve 211 and can have various diameters and lengths so long as the diameter is large enough to enclose the second end 220.

The internal components of muzzle flash simulator 210 are similar to the internal components of muzzle flash simulator 110. The muzzle flash simulator 210 further includes a communication device 117 and a processor 118 installed within plastic sleeve 211. The communication device 117 preferably uses Bluetooth to communicate, although other wireless communication systems such as WiFi can be implemented. The communication device 117 is configured to wirelessly receive instructions transmitted from a computing device. A software application 510 is installed in the computing device so that a user can give instructions to the software and the computing device can wirelessly transmit the instruction data to the communication device 117. The communication device 117 can transmit the received instruction data to the processor 118 so that the processor can control the light source 115. A power supply (e.g. battery) 119 provides electrical power to the muzzle flash simulator 210 and is installed within plastic sleeve 211.

Figure 7B:
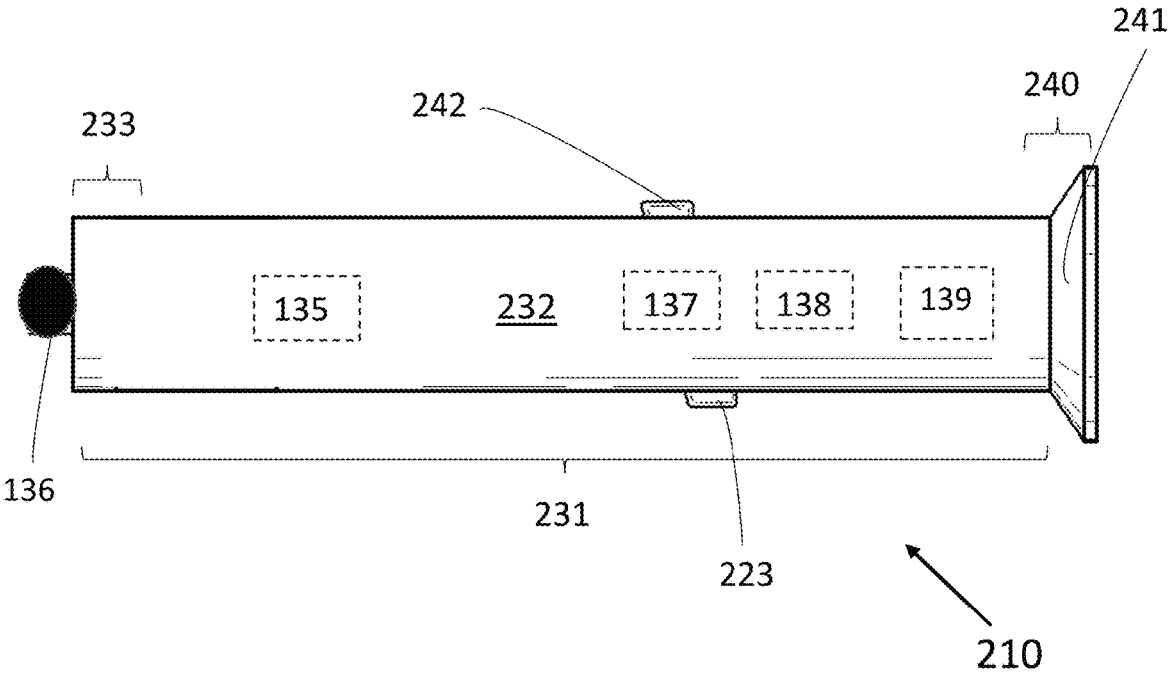
FIG. 7B illustrates a video camera that can be employed in target system.

FIG. 7B illustrates a video camera 230 that can be employed in target system 20. A plastic sleeve 231 houses internal components of the video camera 230. The plastic sleeve body 232 is preferably cylindrically shaped and 3.5 inches in length with a ½ inch diameter, although the body 232 can have various lengths and diameters. Stops 242, 243 are mounted on opposite sides of the plastic sleeve 211 and are preferably constructed of plastic or similar material. The internal components of video camera 230 are similar to the internal components of video camera 130 in target system 10. Video camera components 135 are installed in the video camera 230 and located near the first end 233 within plastic sleeve 231. The video camera 230 is preferably configured to capture images and audio and record the information captured as video data. The camera lens 136 is operatively connected to the video camera components 135 and protrudes from the first end 233. A second end 240 of the plastic sleeve 231 includes an end cap 241. The end cap 241 encloses the second end 240 of the plastic sleeve 231 and can have various diameters and lengths so long as the diameter is large enough to enclose the second end 240.

Figure 8:
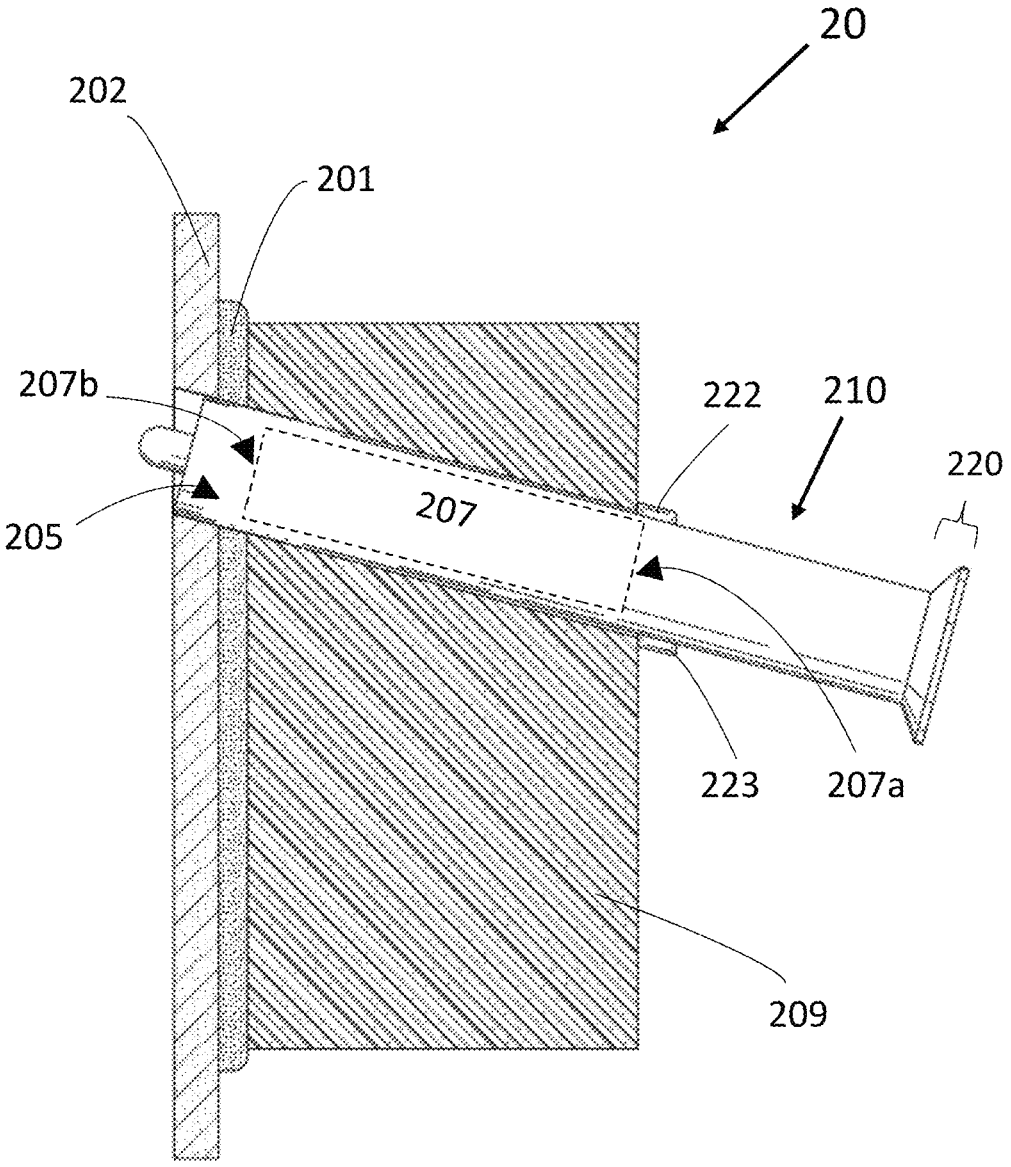
FIG. 8 illustrates a cross-sectional side view of a cardboard target system with a muzzle flash simulator connected.

FIG. 8 illustrates a cross-sectional side view of a cardboard target system 20 with a muzzle flash simulator 210 connected. In this example, the target impact area 202 has a thickness of ⅛ inches. A first hole 205 passes through the entire thickness of target impact area 202. The hole 205 enables light to flow from the muzzle flash simulator 210. The backing 209 also has a hole 207 for connecting the muzzle flash simulator 210. The hole 207 connects to the hole 205 in the target impact area and passes through the entirety of the backing 209, preferably at an angle. The hole 207 has a hole entry point 207*a* located at the rear of the backing 209 and a hole exit point 207*b* located at the front. The muzzle flash simulator 210 can be inserted into the hole entry point 207*a* and pushed through until the first end 233 reaches the hole exit point 207*b*. The holes 205, 207 have diameters wide enough to allow a muzzle flash simulator 210 to narrowly pass through. In this example, the holes 205, 207 have diameters of ½ inches.

The holes in the cross-sectional side view of FIG. 8 can be employed in a similar manner for connecting a muzzle flash simulator 210 or a video camera 230 (shown in FIG. 7B). For example, the camera lens 136 can protrude from hole 206 (shown in FIG. 5) so the video camera 230 can capture images. Similar to hole 205, hole 206 also connects to a hole in the backing 209. The video camera 230 shown in FIG. 7B is also preferably angled so that the second end 220 is below the other portions of the simulator 210, relative to the ground. In this example, the angle is fifteen degrees relative to the ground.

Figure 9:
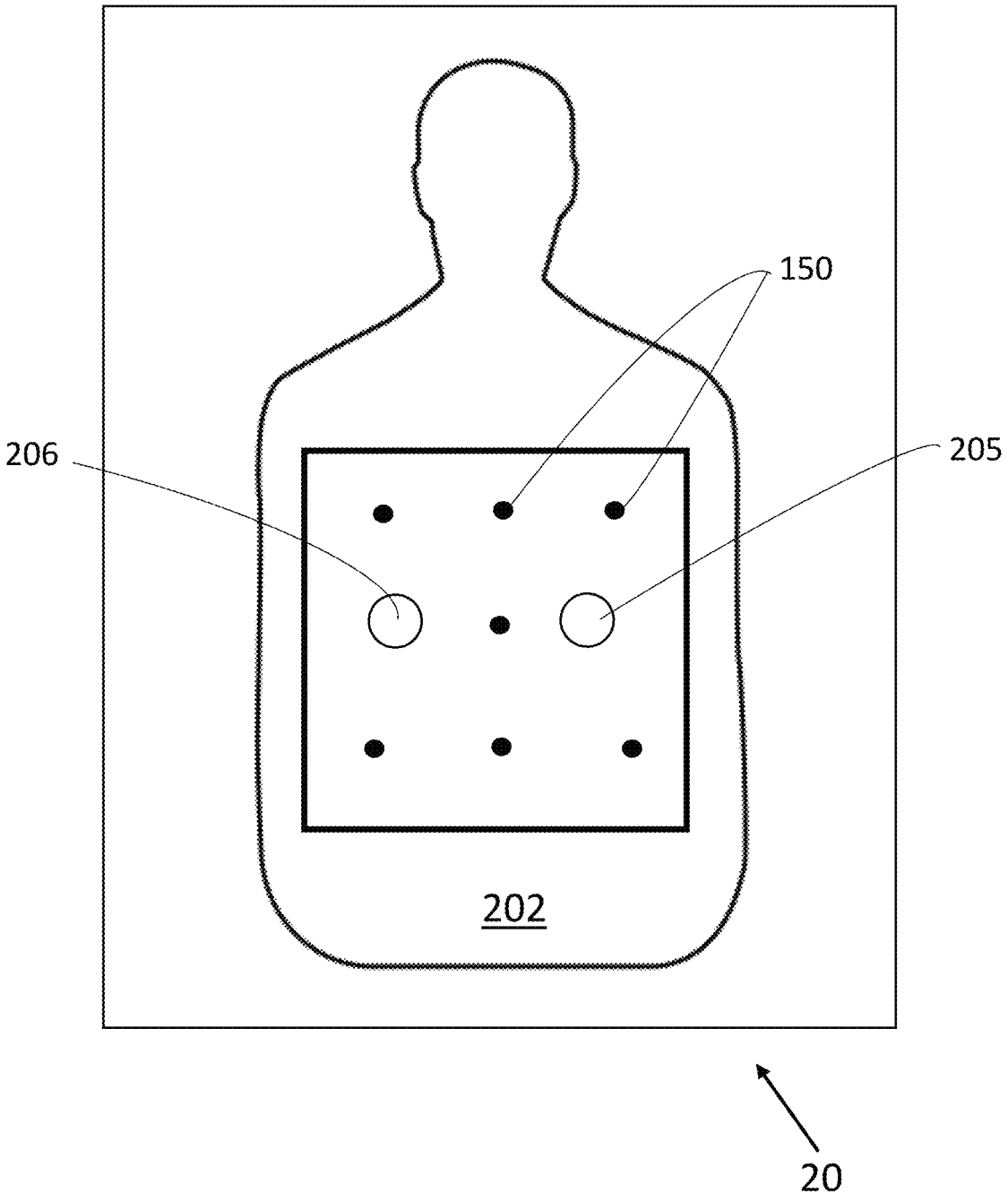
FIG. 9 illustrates a rear view of the target impact area and the backing with a plurality of sensor devices.

FIG. 9 illustrates a rear view of the target impact area 202 and the backing 209 with a plurality of sensor devices 150. The quantity and location of sensor devices 150 shown in this embodiment is a non-limiting example. Various amounts of sensor devices 150 can be implemented and connected to various locations on the target impact area 202.

Figure 10:
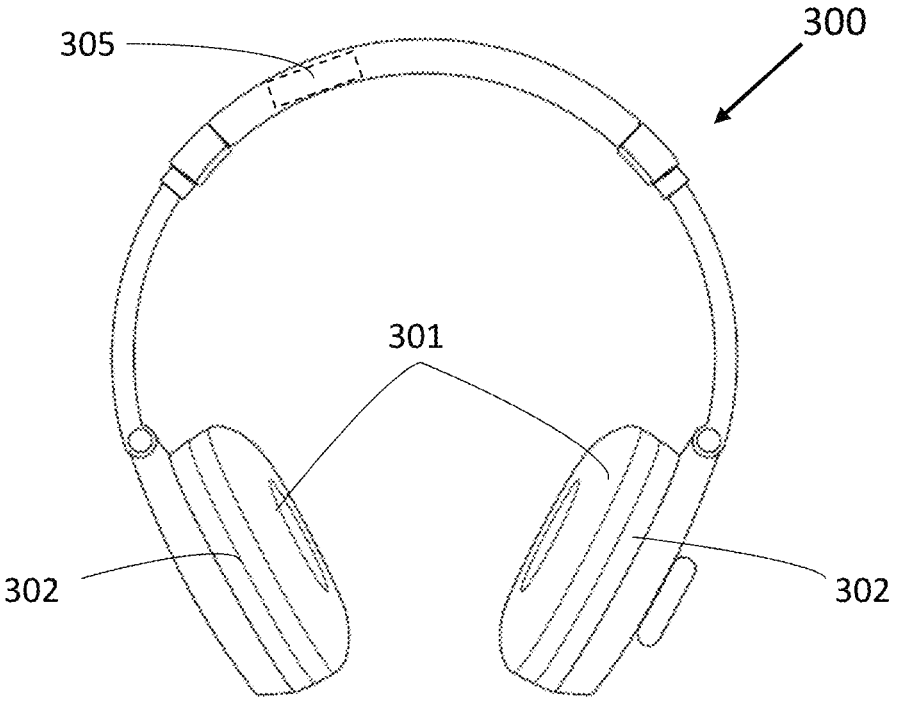
FIG. 10 illustrates a wireless headset that can be worn by a projectile firer and implemented in target system and target system.

FIG. 10 illustrates a wireless headset 300 that can be worn by a projectile firer and implemented in target system 10 and target system 20. The wireless headset preferably has an audio speaker 301 for each ear piece 302. A processor (not shown) is operatively connected to the plurality of audio speakers. A communication device 305 is operatively connected to the processor and is configured to wirelessly receive instruction data from a computing device 500 (FIGS. 12 and 13). The communication device 305 preferably uses Bluetooth to communicate, although other wireless communication systems such as WiFi can be implemented. A software application 510 is installed in the computing device 500 so that a user can give instructions to the software and the computing device 500 can wirelessly transmit the instruction data to the communication device 305. The communication device 305 can transmit the received instruction data to the processor so that the processor can control the audio speakers 301. The audio speakers 301 emit simulated gunshot sounds corresponding to the simulated muzzle flashes emitted by simulators 110, 210. The speakers 301 can be configured by the software application 510 to emit a gunshot sound at the same time as a simulated muzzle flash. An internal power supply (e.g. battery) provides electrical power to the wireless headset 300.

Figure 11:
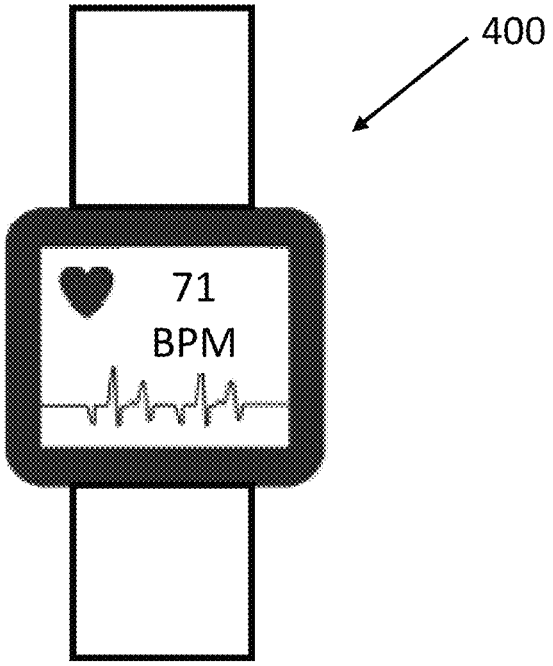
FIG. 11 illustrates an electrocardiogram band that can be employed in target system and target system.

FIG. 11 illustrates an electrocardiogram ("ECG" or "EKG") band 400 that can be employed in target system 10 and target system 20. The EKG band 400 can be worn by a projectile firer ("user") and includes at least one EKG sensor (not shown) that measures electrical signals of the user's heart ("heart activity data"). The EKG band 400 further includes a power supply (e.g. battery), a processor operatively connected to the EKG sensor, and a communication device operatively connected to the processor. The internal components of the EKG band 400 are not shown but their operability will be understood by a person of ordinary skill in the art. The EKG sensor is configured to transmit the measured heart activity to the communication device. The communication device is configured to wirelessly transmit the heart activity data to a computing device, preferably using Bluetooth, WiFi or the like. The software application 510 installed on the computing device stores the heart activity data. The heart activity data can be measured before a target shooting training exercise, during the exercise, and after the exercise so that the user's stress levels can be compared.

FIG. 12 illustrates a target system 10 with a metal target 100, a shooter/user 900, a device for firing a projectile 910, a wireless headset 300, and an EKG 400, and a computing device 500. In this example, the shooter 900 is using a pistol 910 to fire projectiles. Other types of firing devices can be implemented including rifles, shotguns, machine guns, and the like. A software application 510 installed in the computing device 500 can be used to initiate and control a target shooting exercise. The target shooting exercise can be initiated by a shooter 900 or another person/user observing the exercise, such as a range master. During an exercise, the shooter 900 fires projectiles toward the metal target 100. One or more sensor devices 150 connected to target impact area 102 are configured to wirelessly transmit impact data to the computing device 500. The impact data can be stored in the software application 510 to provide feedback for the shooter 900. The video camera 130 records the shooter 900 during the exercise. The video camera 130 preferably uses Bluetooth to communicate with the computing device 500, although other wireless communication systems such as WiFi can be implemented. The video camera 130 is configured to wirelessly transfer video data ("footage") to the computing device 500. The software application 510 can store video data so the shooter's actions can be later reviewed and critiqued to implement improvements in future training exercises. While the shooter 900 engages the target impact area 102, the muzzle flash simulator 110 flashes light toward the shooter 900 at various times. The software application 510 controls the simulated muzzle flashes. The simulated muzzle flashes can be programmed to occur at time intervals, or a range master can control the timing of the muzzle flashes using the application 510. Simultaneously, the audio speakers in the wireless headset 300 emit simulated gunshot sounds corresponding to the simulated muzzle flashes. Wireless headset 300 is worn by the shooter 900 although it is depicted in the FIG. 12 above the shooter 900 for so the headset 300 can be seen clearly. The software application 510 is programmed to control the timing of the muzzle flashes and simulated gunshot sounds. The computing device 500 preferably communicates with the other devices in target system 10 using Bluetooth. The EKG band 400 can be worn by a shooter 900 and includes at least one EKG sensor that measures heart activity data.

FIG. 13 illustrates a target system 20 with a cardboard target 200, a shooter/user 900, a device for firing a projectile 910, a wireless headset 300, and an EKG 400, and a computing device 500. In this example, the shooter 900 is using a pistol 910. Other types of firing devices can be implemented including rifles, shotguns, machine guns, and the like. A software application 510 installed in the computing device 500 can be used to initiate and control a target shooting exercise. The target shooting exercise can be initiated by a shooter 900 or another person/user observing the exercise. During an exercise, the shooter 900 fires projectiles toward the cardboard target 200. One or more sensor devices 150 connected to target impact area 202 are configured to wirelessly transmit impact data to the computing device 500. The impact data can be stored in the software application 510 to provide feedback for the shooter 900. A video camera 130 records the shooter 900 during the exercise and transmit video data to the computing device 500, so the shooter's actions can be later reviewed and critiqued to implement improvements in future training exercises. While the shooter 900 engages the target impact area 202, the muzzle flash simulator 210 flashes light toward the shooter 900 at various times. The simulated muzzle flashes can be programmed to occur at time intervals, or a range master can control the timing of the muzzle flashes using the application 510. Simultaneously, the audio speakers in the wireless headset 300 emit simulated gunshot sounds corresponding to the simulated muzzle flashes. The software application 510 is programmed to control the timing of the muzzle flashes and simulated gunshot sounds. The computing device 500 preferably communicates with the other devices in target system 20 using Bluetooth. The EKG band 400 can be worn by a shooter 900 and includes at least one EKG sensor that measures heart activity data.

What is claimed is:

1. A target system comprising:

a) a device for firing a projectile;

b) a computing device comprising a software application;

c) a target comprising:

i) a target support;

ii) a target impact area comprised of metal;

iii) a rear side of the target impact area includes a first hole;

iv) the first hole includes a plurality of female threads in the rear side of the target impact area;

v) the rear side of the target impact area includes a second hole;

vi) the second hole includes a plurality of female threads in the rear side of the target impact area;

vii) a front side of the target impact area includes a first hole; and viii) the front side of the target impact area includes a second hole;

d) a first metal sleeve comprising:

i) a first end comprising a plurality of male threads;

ii) a light bulb protruding from the first end;

iii) a first power supply;

iv) a light source;

v) a first processor operatively connected to the light source;

vi) a first communication device operatively connected to the first processor;

vii) the first communication device configured to wirelessly receive instruction data from the computing device;

viii) wherein a user gives a first instruction to the software application, the software application generates the instruction data, and the computing device wirelessly transmits the instruction data to the first communication device;

ix) wherein the first communication device receives the instruction data and transmits the instruction data to the first processor;

x) the first processor configured to control the light source based on the instruction data; and xi) a second end comprising a first end cap;

e) the first metal sleeve is operatively connected to the target by fastening the plurality of male threads to the plurality of female threads in the first hole in the rear side of the target impact area;

f) the first hole in the front side of the target impact area enables light to flow from the first metal sleeve and exit the front side of the target impact area;

g) a second metal sleeve comprising:

i) a third end comprising a second plurality of male threads;

ii) a lens protruding from the third end;

iii) a second power supply;

iv) a video camera configured to capture video data;

v) a second processor operatively connected to the video camera;

vi) a second communication device operatively connected to the second processor;

vii) the second communication device configured to wirelessly receive the instruction data from the computing device;

viii) wherein the user gives a second instruction to the software application, the software application generates the instruction data, and the computing device wirelessly transmits the instruction data to the second communication device;

ix) wherein the second communication device receives the instruction data and transmits the instruction data to the second processor;

x) the second processor configured to control the video camera based on the instruction data;

xi) the second communication device further configured to wirelessly transmit the video data to the computing device; and xii) a fourth end comprising second end cap;

h) the second metal sleeve is operatively connected to the target by fastening the second plurality of male threads to the plurality of female threads in the second hole in the rear side of the target impact area;

i) the second hole in the front side of the target impact area enables the video camera to capture video from the front side of the target impact area;

j) a sensor device operatively connected to the target impact area, the sensor device comprising:

i) a third power supply;

ii) a vibration sensor for sensing an impact of the projectile;

iii) a third processor operatively connected to the vibration sensor;

iv) a third communication device operatively connected to the third processor;

v) the third communication device configured to wirelessly receive the instruction data from the computing device;

vi) the vibration sensor configured to transmit impact data to the third communication device; and vii) the third communication device further configured to wirelessly transmit the impact data to the computing device;

k) a wireless headset comprising:

i) a fourth power supply;

ii) a plurality of audio speakers;

iii) a fourth processor operatively connected to the plurality of audio speakers;

iv) a fourth communication device operatively connected to the fourth processor;

v) the fourth communication device configured to wirelessly receive the instruction data from the computing device;

vi) wherein the user gives a third instruction to the software application, the software application generates the instruction data, and the computing device wirelessly transmits the instruction data to the fourth communication device;

vii) wherein the fourth communication device receives the instruction data and transmits the instruction data to the fourth processor; and viii) the fourth processor configured to control the plurality of audio speakers based on the instruction data;

l) the software application configured to store the impact data and the video data.

2. The target system of claim 1 further comprising an electrocardiogram (EKG) band worn by the user, the EKG band comprising:

a) a fifth power supply;

b) an EKG sensor for measuring heart activity of the user;

c) a fifth processor operatively connected to the EKG sensor;

d) a fifth communication device operatively connected to the fifth processor;

e) the EKG sensor configured to transmit heart activity data to the fifth communication device;

f) the fifth communication device configured to wirelessly transmit the heart activity data to the computing device; and g) the software application further configured to store the heart activity data.

3. The target system of claim 1, wherein the light source is a light emitting diode (LED).

4. The target system of claim 1, wherein each of the communication devices wirelessly transmit and receive data via Bluetooth.

5. The target system of claim 1, wherein each of the communication devices wirelessly transmit and receive data via Wi-Fi.

6. A target system comprising:

a) a device for firing a projectile;

b) a computing device comprising a software application;

c) a target comprising:

i) a target support;

ii) a target impact area comprised of cardboard;

iii) the target impact area includes a first hole passing through the target impact area;

iv) the target impact area includes a second hole passing through the target impact area;

v) a foam backing affixed to a rear side of the target impact area;

vi) the rear side of the foam backing includes a first hole;

vii) the rear side of the foam backing includes a second hole;

viii) the front side of the foam backing includes a first hole; and ix) the front side of the foam backing includes a second hole;

d) a first plastic sleeve comprising:

i) a first end;

ii) a light bulb protruding from the first end;

iii) a first power supply;

iv) a light source;

v) a first processor operatively connected to the light source;

vi) a first communication device operatively connected to the first processor;

vii) the first communication device configured to wirelessly receive instruction data from the computing device;

viii) wherein a user gives a first instruction to the software application, the software application generates the instruction data, and the computing device wirelessly transmits the instruction data to the first communication device;

ix) wherein the first communication device receives the instruction data and transmits the instruction data to the first processor;

x) the first processor configured to control the light source based on the instruction data; and xi) a second end comprising a first end cap;

e) the first plastic sleeve is operatively connected to the target by inserting the first plastic sleeve in the first hole in the rear side of the foam backing until the first end reaches the first hole in the front side of the foam backing;

f) the first plastic sleeve is secured to the rear side of the foam backing using a first set of plastic stops;

g) the first hole through the target impact area enables light to flow from the first plastic sleeve and exit the front side of the target impact area;

h) a second plastic sleeve comprising:

i) a third end;

ii) a lens protruding from the third end;

iii) a second power supply;

iv) a video camera configured to capture video data;

v) a second processor operatively connected to the video camera;

vi) a second communication device operatively connected to the second processor;

vii) the second communication device configured to wirelessly receive the instruction data from the computing device;

viii) wherein the user gives a second instruction to the software application, the software application generates the instruction data, and the computing device wirelessly transmits the instruction data to the second communication device;

ix) wherein the second communication device receives the instruction data and transmits the instruction data to the second processor;

x) the second processor configured to control the video camera based on the instruction data;

xi) the second communication device further configured to wirelessly transmit the video data to the computing device; and xii) a fourth end comprising a second end cap;

i) the second plastic sleeve is operatively connected to the target by inserting the second plastic sleeve in the second hole in the rear side of the foam backing until the third end reaches the second hole in the front side of the foam backing;

j) the second plastic sleeve is secured to the rear side of the foam backing using a second set of plastic stops;

k) the second hole through the target impact area enables the video camera to capture video from the front side of the target impact area;

l) a sensor device affixed to the foam backing and operatively connected to the target impact area, the sensor device comprising:

i) a third power supply;

ii) a vibration sensor for sensing an impact of the projectile;

iii) a third processor operatively connected to the vibration sensor;

iv) a third communication device operatively connected to the third processor;

v) the third communication device configured to wirelessly receive the instruction data from the computing device;

vi) the vibration sensor configured to transmit impact data to the third communication device; and vii) the third communication device further configured to wirelessly transmit the impact data to the computing device;

m. a wireless headset comprising:

i) a fourth power supply;

ii) a plurality of audio speakers;

iii) a fourth processor operatively connected to the plurality of audio speakers;

iv) a fourth communication device operatively connected to the fourth processor;

v) the fourth communication device configured to wirelessly receive the instruction data from the computing device;

vi) wherein the user gives a third instruction to the software application, the software application generates the instruction data, and the computing device wirelessly transmits the instruction data to the fourth communication device;

vii) wherein the fourth communication device receives the instruction data and transmits the instruction data to the fourth processor; and viii) the fourth processor configured to control the plurality of audio speakers based on the instruction data;

n. the software application configured to store the impact data and the video data.

7. The target system of claim 6 further comprising an electrocardiogram (EKG) band worn by the user, the EKG band comprising:

a) a fifth power supply;

b) an EKG sensor for measuring heart activity of the user;

c) a fifth processor operatively connected to the EKG sensor;

d) a fifth communication device operatively connected to the fifth processor;

e) the EKG sensor configured to transmit heart activity data to the fifth communication device;

f) the fifth communication device configured to wirelessly transmit the heart activity data to the computing device; and g) the software application further configured to store the heart activity data.

8. The target system of claim 6, wherein the first processor is configured to deliver a simulated muzzle flash combined with a simulated gunshot sound.

9. The target system of claim 6, wherein the light source is a light emitting diode (LED).

10. The target system of claim 6, wherein each of the communication devices wirelessly transmit and receive data via Bluetooth.

11. The target system of claim 6, wherein each of the communication devices wirelessly transmit and receive data via Wi-Fi.

12. The target system of claim 6, wherein the foam backing is affixed to the rear side of the target impact area using double sided tape.

* * * * *